US005704665A

United States Patent [19]

Budolfson

[11] Patent Number: 5,704,665

[45] Date of Patent: Jan. 6, 1998

[54] PORTABLE DOOR SECURING DEVICE

[76] Inventor: Robert A. Budolfson, 18525 Sixth Ave. North, Plymouth, Minn. 55447

[21] Appl. No.: 638,072

[22] Filed: Apr. 25, 1996

[51] Int. Cl.[6] ..... E05C 19/18

[52] U.S. Cl. ..... 292/295; 292/290; 292/292

[58] Field of Search ..... 292/288, 289, 292/291, 292, 295, 290, 296, 297

[56] References Cited

U.S. PATENT DOCUMENTS

| | | | |
|---|---|---|---|
| 1,782,289 | 11/1930 | Cox | 292/295 |
| 2,588,077 | 3/1952 | Beadle | 292/295 |
| 2,903,286 | 9/1959 | Richard et al. | 292/295 |
| 3,596,961 | 8/1971 | Lippman | 292/292 |
| 3,726,555 | 4/1973 | Lawson | 292/288 X |
| 4,653,786 | 3/1987 | Bopst, III | 292/295 |
| 4,964,662 | 10/1990 | O'Leary | 292/295 |
| 5,193,867 | 3/1993 | Husted | 292/295 X |
| 5,401,068 | 3/1995 | Barnard | 292/295 X |

*Primary Examiner*—Rodney M. Lindsey
*Attorney, Agent, or Firm*—Roger W. Jensen

[57] ABSTRACT

A press fitted stud on one end of a metal strip is hooked into the opening of a striker plate in a door jamb and the strip extends in the space between the jamb and the edge of the door past the jamb and closed door. The extended end of the plate has holes for receiving a knurled locking pin which holds a locking plate tightly against the closed door and the door jamb to keep the door securely closed. Resilient pads of different thickness and compressibility on the locking plate facing the door keep the door tightly closed.

2 Claims, 1 Drawing Sheet

PORTABLE DOOR SECURING DEVICE

FIELD OF THE INVENTION

This invention is a portable door-securing device which can be readily attached by an occupant of a room from the inside to hold the door securely closed and yet be readily and quickly removed to open the door. It is used in addition to conventional deadbolt locks and requires no modification to conventional doors, door frames or jambs.

DESCRIPTION OF THE PRIOR ART

The closest prior art is a commercially available device as shown in U.S. Pat. No. 4,964,662 issued Oct. 23, 1990. The instant invention is an improvement over this prior art.

SUMMARY OF THE INVENTION

Similar to the prior art, an elongated rigid strip has a stud near one end for engaging the striker plate hole in a door jamb and extends from the striker plate hole into the interior of the room through the gap between the closed door and the door jamb. The extended portion has a plurality of parallel rows of equally dimensioned through holes; said plurality of parallel rows being alternately staggered, in the preferred embodiment. A generally rectangular rigid locking plate has a center slot to enable it to slide over and along the extended end of the rigid strip orthogonal to the rigid strip to press up against the closed door and the jamb. A locking spring clip is provided; it includes a central spring means and two extending end pieces, which, when at rest, are spaced apart a distance greater than the lateral spacing of said plurality of parallel rows of holes in said rigid strip. When the end pieces are moved toward one another, against the biasing spring force of the central spring means, then such ends may be inserted through and thus be engageable with two of said plurality of holes, i.e., a first hole in a first of said rows of holes and a second hole in a second of said rows of holes. In this manner, by optimum selection of said two holes, the spring clip holds the locking plate firmly and securely in place against the door and the door frame. Resilient pads are attached to the side of the locking plate facing the door and the door frame or jamb to prevent marring of the door and the door frame surfaces and to permit the locking plate to be pushed firmly against the door and door jamb or frame so that when the locking spring clip is in place, the door is held firmly closed. The pads may differ in thicknesses to compensate for unevenness between the door and frame, e.g., if the door is not flush with the door frame, i.e., if the inner surface of the door and the inner surface of the door frame are not in the same plane when the door is closed or if there is a molding on the door jamb. Also, at the inner rigid end the rigid strip is angled away from the door to make it easier to place the locking device in position when closing the door.

The locking stud is machine pressed onto the strip to insure that it will not break loose if excess pressure is applied to the door. An important feature is that the locking spring clip is characterized so that the ends thereof are biased to snugly enable the holes through which they extend, as aforesaid, to prevent any unintentional disengagement due to a shaking or jiggling of the door.

DESCRIPTION OF THE PREFERRED EMBODIMENT

Figure 1:
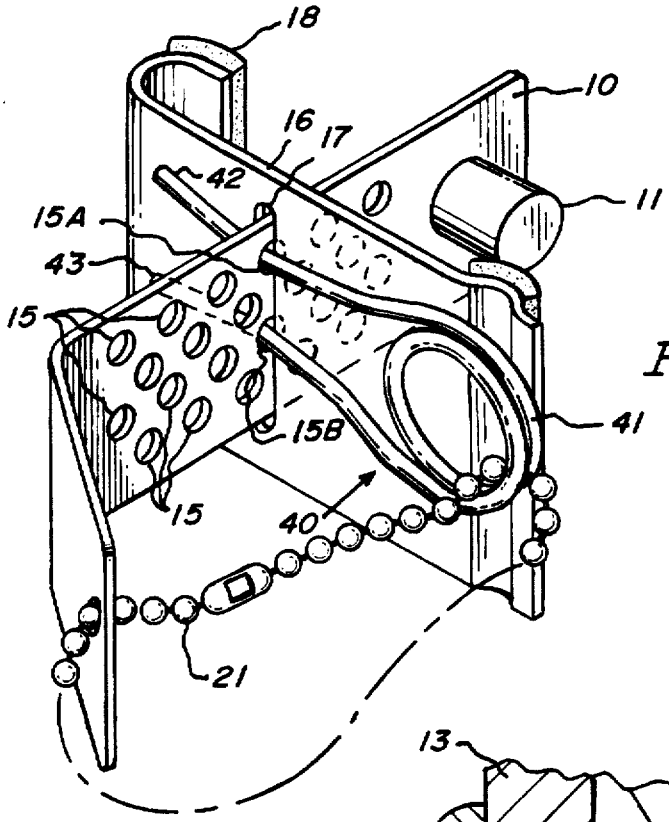
FIG. 1 is a perspective view of the invention.
Figure 2:
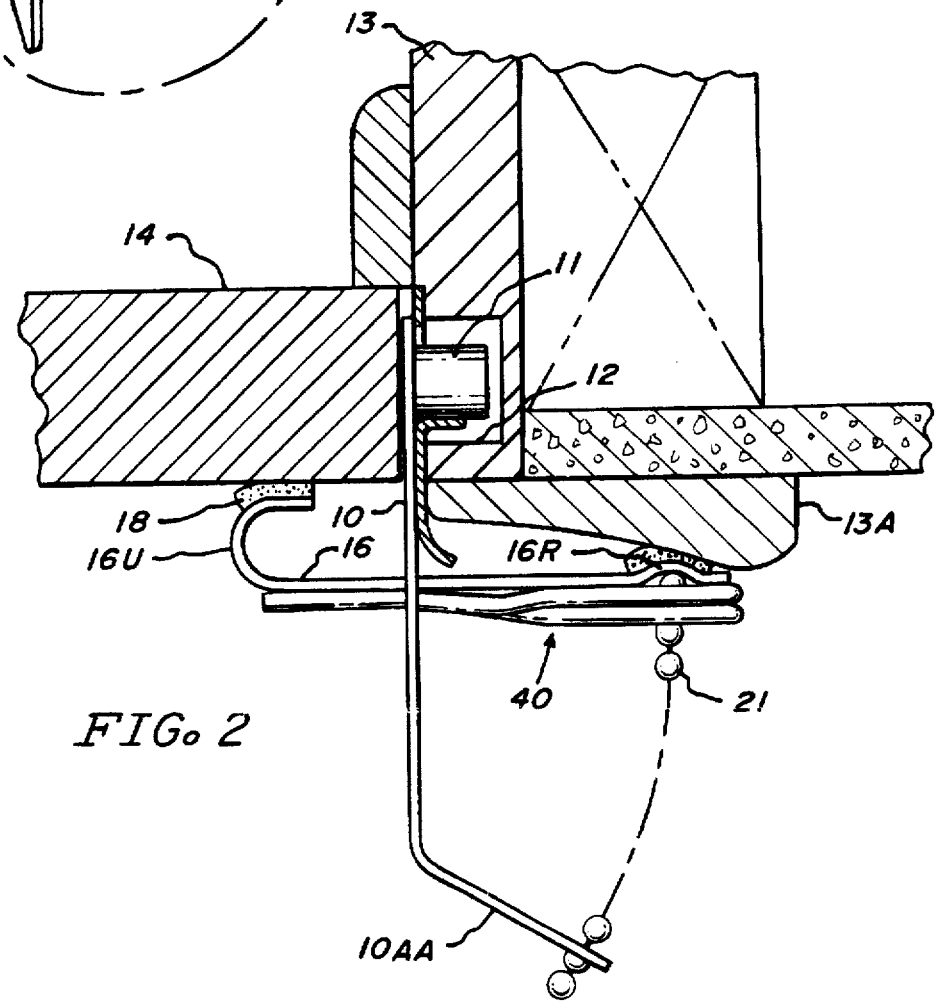
FIG. 2 is a cross-section showing a portion of the door and the door jamb with the invention in use to secure the closed door.

An elongated rigid strip 10, made of a material having a suitable strength, has a stud 11 attached at one end which extends out orthogonally from one of the major surfaces of the strip 10 and engages a conventional striker plate opening 12 in a door jamb 13 for a door 14. A door jamb trim strip 13A abuts the door jamb 13. Conventionally, a spring-biased latch in the door normally engages the striker plate opening when the door is closed but, with this invention, the latch is held recessed back into the door and is not shown for clarity. Strip 10 extends from the striker plate opening 12 through the space between the edge of the closed door 14 and jamb 13 into the interior of the room. The inner extending portion of strip 10 has a number of rows equally dimensioned through holes 15 which are spaced apart in a staggered fashion. In FIG. 1, four parallel rows of holes 15 are shown, alternately staggered to provide a larger number of choices for insertion of the spring clip. At its furthest interior end 10A rigid strip 10 is angled away from the door (reference number 10AA) to make it easier to hold the strip in place after the stud has been inserted and while the door is being closed. A rigid generally rectangular locking plate member 16, also made out of a material of suitable strength, such as sheet steel, has a central slot 17 for accommodating rigid strip 10 so that locking plate 16 can be slid back and forth along rigid strip 10. The locking plate 16 has (at the left end as shown in FIG. 2) a u-shaped end 16U facing door 14, a resilient pad 18 being adhesively attached to end 16U. At the other end of locking plate 16 a shoulder or ridge 16R having adhesively attached a resilient pad 19 adapted to abut door jamb trim strip 13A.

A locking spring clip means 40 has a central spring means 41 and two extending end pieces 42 and 43. In the preferred embodiment, the locking means is made from a suitable metal spring wire having a round cross-section. Thus the central spring means comprises at least one complete loop (in the preferred embodiment) of the spring wire; the drawings show one full loop plus a partial second loop, regard being given to ends 42 and 43.

In use, door 14 is first held partially ajar to enable the stud 11 to be inserted into the striker hole 12 and door 14 is then closed and, if necessary, the strip 10 is pulled so that the stud 11 rests against an edge of the striker hole 12. Locking plate 16 engaged with strip 10 via slot 17 is then pushed firmly against the door and the door jamb compressing pads 18 and 19 to make firm pressing contact against the door and the door jamb and then the ends 42 and 43 of the locking spring clip means 40 are moved toward one another an appropriate distance so as to permit the insertion thereof into those two of the holes 15 which facilitate the closest or snuggest engagement of the locking plate 16 against the door 14 and door jamb 13–13A; these two holes being identified in FIG. 1 by reference numerals 15A and 15B.

Frequently, because of the door jamb trim strip 13, there is an offset between the outer surface of the door and the door jamb. The u-shaped end 16U of the locking plate 16 has a lateral dimension to accommodate the usual offset. The pads 18 and 19 may be of the same thickness or, if desired, may be of different thickness.

A chain 21 or equivalent may be used to secure the spring clip means 41 to the angled portion 10AA of the rigid strip 10. It further should be understood that the chain 21, as long as it is attached as aforesaid, will prevent the rigid strip from being completely separated from the locking plate member 16.

Thus the above described invention has significant and unique advantages as compared to said U.S. Pat. No. 4,964,662.

The embodiments of an invention in which an exclusive property or right is claimed are defined as follows:

1. A portable securing device for a door which is hingedly mounted in an opening which has a door jamb with a striker plate having an opening in the door jamb for receiving a latch, there being a space between the side edge of the door and the door jamb when the door is closed, said device having a rigid strip member adapted for positioning in the space between the door and the door jamb, a rigid stud extending out from one surface of the strip member near one end and adapted for engaging the striker plate opening and with the strip member (i) defining an extended portion being adapted for extending beyond an inner plane of the door and the door jamb when the door is closed, and (ii) having a plurality of parallel rows of holes extending logitudinally thereof, said rows being laterally spaced apart, and a rigid locking plate member having a centered slot engaging the strip member so that the locking plate member is slideably movable along the extended portion of the strip member with the locking plate extending over the door jamb and the door when the door is closed, the improvement comprising:

(a) compressible pad means on said locking plate adapted to be facing the door and the door jamb; and (b) a locking spring clip having a central spring means and two extending end pieces which, when at rest, are spaced apart a distance greater than said lateral spacing of said plurality of parallel rows of holes in said rigid strip member, and which may be moved toward one another, against the force of said central spring means, and then engageable with two of said holes in said rigid strip member for making pressing engagement against said locking plate.

2. The securing device of claim 1 wherein said plurality of parallel rows of holes are alternately staggered.

* * * * *